US011309103B2

(12) United States Patent
Nagano et al.

(10) Patent No.: US 11,309,103 B2
(45) Date of Patent: Apr. 19, 2022

(54) SHIELDED FLAT CABLE

(71) Applicant: SUMITOMO ELECTRIC INDUSTRIES, LTD., Osaka (JP)

(72) Inventors: Manabu Nagano, Tochigi (JP); Go Hirakawa, Tochigi (JP); Shin Sato, Tochigi (JP); Tatsuo Matsuda, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/047,844

(22) PCT Filed: Apr. 11, 2019

(86) PCT No.: PCT/JP2019/015859
§ 371 (c)(1),
(2) Date: Oct. 15, 2020

(87) PCT Pub. No.: WO2019/208247
PCT Pub. Date: Oct. 31, 2019

(65) Prior Publication Data

US 2021/0166836 A1 Jun. 3, 2021

(30) Foreign Application Priority Data

Apr. 23, 2018 (JP) ..... JP2018-082576

(51) Int. Cl.
*H01B 7/08* (2006.01)
*H01B 13/06* (2006.01)
*H01B 13/22* (2006.01)

(52) U.S. Cl.
CPC ..... *H01B 7/0861* (2013.01); *H01B 7/0838* (2013.01); *H01B 13/06* (2013.01); *H01B 13/22* (2013.01)

(58) Field of Classification Search
CPC .... H01B 7/0861; H01B 7/0838; H01B 13/06; H01B 13/22
See application file for complete search history.

(56) References Cited

U.S. PATENT DOCUMENTS 3,576,723 A * 4/1971 Angele et al. ..... H01B 7/0838 205/187
3,612,743 A * 10/1971 Angele ..... H01B 7/0838 174/36

(Continued)

FOREIGN PATENT DOCUMENTS

JP S60-26130 U 2/1985
JP H2-59521 U 5/1990

(Continued)

*Primary Examiner* — William H. Mayo, III
*Assistant Examiner* — Rhadames Alonzo Miller
(74) *Attorney, Agent, or Firm* — IPUSA, PLLC

(57) ABSTRACT

A shielded flat cable 1 includes one or more ground wires G1, the ground wires G1 being arrayed parallel to each other, one or more signal wires S1 and S2 arrayed parallel to the one or more ground wires G1, insulating layers 11 and 12 covering the one or more ground wires G1 and the signal wires S1 and S2, and shield layers 21 and 22 provided on outer surfaces of the insulating layers 11 and 12. In a cross-section of the one or more ground wires, the insulating layers 11 and 12 include openings 13 and 14 of which bottoms are respectively an upper surface and a lower surface of one ground wire G1, and the one ground wire G1 and the shield layers 21 and 22 are electrically coupled at the openings 13 and 14, and the signal wires S1 and S2 are surrounded by the one or more ground wires G1 and the shield layers 21 and 22.

13 Claims, 6 Drawing Sheets

(56) References Cited

U.S. PATENT DOCUMENTS

| | | | | | |
|---|---|---|---|---|---|
| 4,209,215 | A * | 6/1980 | Verma | H01B 7/0838 | 439/497 |
| 4,283,593 | A * | 8/1981 | Piasecki | H01B 7/08 | 174/112 |
| 4,596,897 | A * | 6/1986 | Gruhn | H01B 11/1091 | 174/36 |
| 4,616,102 | A * | 10/1986 | Noorily | H01B 7/0838 | 174/117 FF |
| 4,845,311 | A * | 7/1989 | Schreiber | H01P 3/06 | 174/36 |
| 5,003,126 | A * | 3/1991 | Fujii | G02B 6/4403 | 174/115 |
| 5,250,127 | A * | 10/1993 | Hara | H01B 7/385 | 156/247 |
| 5,342,991 | A * | 8/1994 | Xu | H01B 7/0823 | 174/115 |
| 5,446,239 | A * | 8/1995 | Mizutani | H01B 7/0838 | 174/117 F |
| 5,455,383 | A * | 10/1995 | Tanaka | H01B 7/0861 | 174/117 A |
| 6,495,764 | B1 * | 12/2002 | Hori | H01B 7/0861 | 174/117 F |
| 2009/0126972 | A1 * | 5/2009 | Matsushita | H01B 7/0861 | 174/113 R |

FOREIGN PATENT DOCUMENTS

| | | |
|---|---|---|
| JP | H3-501435 | 3/1991 |
| JP | H6-267339 | 9/1994 |
| JP | H6-283053 | 10/1994 |
| WO | 90/01222 | 2/1990 |

* cited by examiner

SHIELDED FLAT CABLE

TECHNICAL FIELD

The present disclosure relates to a shielded flat cable. The present application is based on and claims priority to Japanese Application No. 2018-082576, filed on Apr. 23, 2018, the entire contents of which are incorporated herein by reference.

BACKGROUND ART

Flexible flat cables (FFCs) are used to save space and to make easy connections in many fields including audio visual equipment, such as CD and DVD players, office automation equipment, such as copiers and printers, and internal wiring of other electronic and information equipment. The higher the frequency used in the equipment is, the greater the influence of noise is. Thus, shielded flat cables are used.

Shielding of the shielded flat cable is achieved by, for example, providing a shield layer outside the FFC. As described in Patent Document 1, for example, the shield layer is electrically coupled to the ground wire through an opening provided on one side of the ground wire and maintained at the ground potential on a substrate side through the ground wire.

PRIOR ART DOCUMENTS

Patent Documents

[Patent Document 1] Japanese Laid-open Patent Publication No. 6-283053

SUMMARY OF THE INVENTION

A shielded flat cable according to the present disclosure includes one or more ground wires, the ground wires being arrayed parallel to each other, one or more signal wires arrayed parallel to the one or more ground wires, an insulating layer covering the one or more ground wires and the one or more signal wires, and a shield layer provided on an outer surface of the insulating layer. The insulating layer includes multiple openings of which bottoms are respectively an upper surface and a lower surface of each of the one or more ground wires in a cross-section of the one or more ground wires. The one or more ground wires and the shield layer are electrically coupled at the multiple openings, and each of the one or more signal wires is surrounded by the one or more ground wires and the shield layer.

EMBODIMENT FOR CARRYING OUT THE INVENTION

Figure 1:
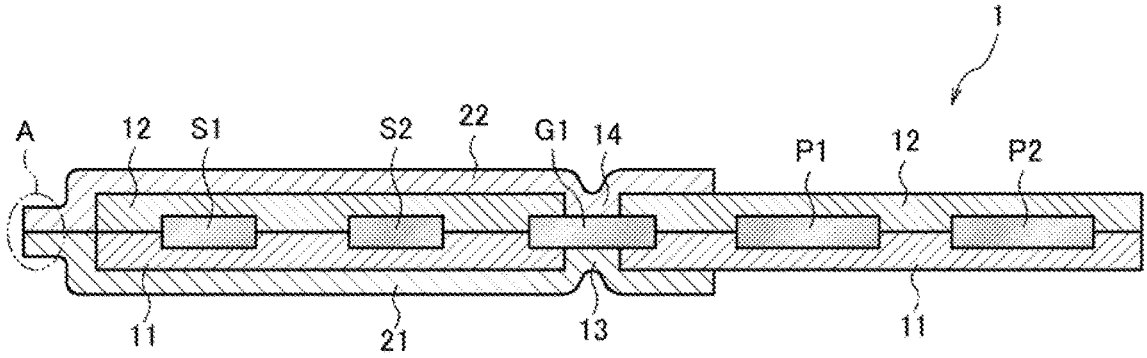
FIG. 1 is a cross-sectional view orthogonal to a longitudinal direction, illustrating a schematic view of a shielded flat cable according to a first embodiment of the present disclosure.

Problem to Be Solved by the Present Disclosure

Each conductor surrounded by the shielded layer is not easily influenced by noise from the outside of the cable and does not adversely affect the outside of the cable, such as generating noise. Thus, each conductor can achieve high-speed signal transmission. However, crosstalk occurs between conductors surrounded by the shield layer. Additionally, when power wires are provided with conductors, the conductors are influenced by noise transmitted through the power wires.

The present disclosure has been made in view of these conditions and aims to provide a shielded flat cable that can shield predetermined signal wires with certainty and that is not easily influenced by external noise and crosstalk.

Effect of the Present Disclosure

According to the present disclosure, a predetermined signal wire can be surrounded by a ground wire and a shield layer to provide a shielded flat cable that can shield the predetermined signal wire and that is not easily influenced by external noise and crosstalk.

Description of Embodiments of the Present Disclosure

First, contents of embodiments of the present disclosure will be described by listing. (1) A shielded flat cable according to one aspect of the present disclosure is a shielded flat cable including one or more ground wires, the ground wires being arrayed parallel to each other, one or more signal wires arrayed parallel to the one or more ground wires, an insulating layer covering the one or more ground wires and the one or more signal wires, and a shield layer provided on an outer surface of the insulating layer. The insulating layer includes multiple openings, the bottoms of which are respectively an upper surface and a lower surface of each of the one or more ground wires in a cross-section orthogonal to a longitudinal direction of the one or more ground wires. The one or more ground wires and the shield layer are electrically coupled at the multiple openings, and each of the one or more signal wires is surrounded by the one or more ground wires and the shield layer.

With this configuration, a predetermined signal wire can be surrounded by the ground wire and the shield layer, so that the predetermined signal wire can be shielded with certainty, and is not easily influenced by external noise and crosstalk.

(2) In the cross-section orthogonal to the longitudinal direction of the ground wire, the one or more signal wires are arrayed on one end of an array of the one or more ground wires and the one or more signal wires. The one or more signal wires on the one end may be surrounded by a closest ground wire and the shield layer electrically coupled at the multiple openings of which bottoms are respectively an upper surface and a lower surface of the closest ground wire. The closest ground wire is closest to the one or more signal wires on the one end. With this configuration, the signal wire arrayed on the end of an array of the shielded flat cable can be surrounded by the ground wire and the shield layer, so that the signal wire on the end can be shielded with certainty, and is not easily influenced by external noise and crosstalk.

(3) In the cross-section orthogonal to the longitudinal direction of the ground wire, the signal wire may be surrounded by two ground wires. The signal wire is disposed between the two ground wires, and the two ground wires and the shield layer are electrically coupled at the openings of which bottoms are respectively upper surfaces and lower surfaces of the two ground wires between which the signal wire is disposed. With this configuration, the signal wire arrayed on the end or the center of the shielded flat cable can be surrounded by the ground wires provided on both sides of the signal wire in the array direction and the shield layer, so that the signal wire arrayed on the end or the center can be shielded with certainty and is not easily influenced by external noise and crosstalk.

(4) The signal wires preferably include one signal wire for signal transmission or a pair of signal wires arranged adjacent and parallel to each other for differential transmission. With these configurations, each signal wire or each pair of signal wires for differential transmission can be surrounded by the ground wire and the shield layer, so that the signal wire can be shielded with certainty and is not easily influenced by external noise and crosstalk.

(5) A resin interlayer may be interposed between the insulating layer and the shield layer. With this configuration, the characteristic impedance of the shielded flat cable is easily adjusted to a predetermined value.

(6) The width of the opening is preferably smaller than or equal to half of the width of the ground wire in the array direction. With this configuration, even in a severe use environment, the insulating layer is not separated at a position of the ground wire and the bonding strength of the ground wire can be maintained.

(7) A power wire of which an outer surface is covered by only the insulating layer may be further included. With this configuration, signal transmission using the signal wire and power transmission can be performed using a single shielded flat cable, and the signal wire is not easily influenced by noise transmitted through the power wire.

Details of Embodiment of the Present Disclosure

In the following, a preferred embodiment of the shielded flat cable of the present disclosure will be described with reference to the drawings. In the following description, components referenced by the same reference numerals in different drawings are considered to be similar, and the description may be omitted. Here, the present invention is not limited to examples of these embodiments, but includes all modifications within the scope of the claims and equivalents. The invention also includes a combination of any embodiments as long as the combination is possible.

First Embodiment

Figure 2A:
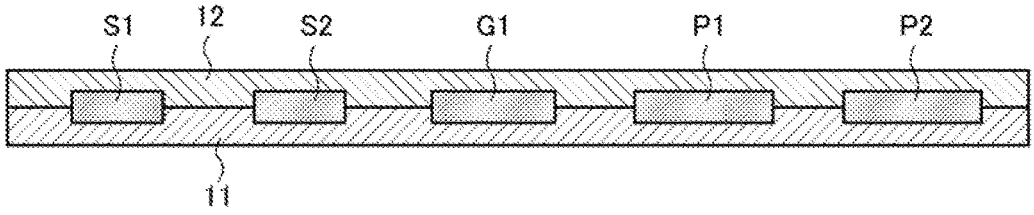
FIG. 2A is a cross-sectional view orthogonal to the longitudinal direction, for describing an example of a process of manufacturing the shielded flat cable according to the first embodiment of the present disclosure.
Figure 2B:
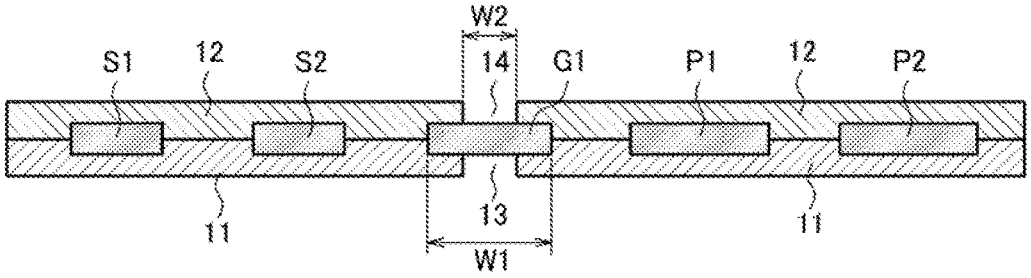
FIG. 2B is a cross-sectional view orthogonal to the longitudinal direction, for describing an example of a process of manufacturing the shielded flat cable according to the first embodiment of the present disclosure.

FIG. 1 is a cross-sectional view orthogonal to the longitudinal direction, illustrating a schematic view of a shielded flat cable according to a first embodiment of the present disclosure, and FIG. 2A and FIG. 2B are cross-sectional views orthogonal to the longitudinal direction for describing an example of a process of manufacturing the shielded flat cable according to the first embodiment of the present disclosure.

A shielded flat cable 1 according to the present embodiment includes multiple conductors including a pair of signal wires S1 and S2, a ground wire G1, and power wires P1 and P2 arrayed parallel to each other, a first insulating layer 11 and a second insulating layer 12 covering the conductors, a first shield layer 21 and a second shield layer 22 respectively covering portions of outer surfaces of the first insulating layer 11 and the second insulating layer 12. The signal wires S1 and S2 are positioned at one end in the array direction of conductors of the shielded flat cable 1.

On both sides of the ground wire G1, exposed surfaces are formed by openings 13 and 14 provided in the first and second insulating layers 11 and 12. The respective bottom surfaces of the openings 13 and 14 are the upper surface and the lower surface of the ground wire G1 and extend over the entire length of the ground wire G1 in the longitudinal direction. At the opening 13, the ground wire G1 and the first shield layer 21 are electrically coupled, and at the opening 14, the ground wire G1 and the second shield layer 22 are electrically coupled. The first and second shield layers 21 and 22 are electrically coupled at an end A protruding from a side of the shielded flat cable 1 in the width direction. Thus, the pair of signal wires S1 and S2 is surrounded by the first shield layer 21, the ground wire G1, the second shield layer 22, and the end A. The shielded flat cable 1 includes terminals at both ends in the longitudinal direction. Except for the terminals at both ends, a protective resin layer covering the entire shielded flat cable 1 (which is not illustrated) may be provided.

The signal wires S1 and S2 may be, for example, conductive metals, such as copper foil, tin-plated soft copper foil, and may be flat conductors having a thickness from 10 μm to 100 μm and a width from about 0.2 mm to 0.8 mm. The signal wires S1 and S2 are arrayed with a pitch from 0.5 mm to 1.0 mm. The conductor size and pitch of the signal wires S1 and S2 are determined based on requirements of the transmission loss and the characteristic impedance of a differential pair. The arrangement of the signal wires S1 and S2 is maintained by interposing the signal wires S1 and S2 between the first and second insulating layers 11 and 12. In the present embodiment, with respect to the signal wire, a case in which the pair of signal wires S1 and S2 are used for the differential transmission is described, but the signal wire may be a single signal wire when the differential transmission is not performed.

The ground wire G1 is a conductor that, at the same time when the shielded flat cable 1 is connected to a substrate constituting equipment, is electrically coupled to a ground layer of the substrate and grounded. The ground wire G1 may be configured as a flat conductor similar to the signal wires S1 and S2, but preferably have a width greater than the width of the signal wires S1 and S2, such as a width of about 1 mm to 5 mm.

The power wires P1 and P2 are conductors that supply power to electronic and electric devices and electronic components to which the shielded flat cable 1 is connected. The power wires P1 and P2 may be configured as flat conductors similar to the signal wires S1 and S2, but cross-sectional areas of the power wires P1 and P2 are configured to be greater than cross-sectional areas of the signal wires S1 and S2 and the ground wire G1 in accordance with the amount of a flowing current. When the power wires P1 and P2 are not required, the power wires P1 and P2 may be omitted.

The first and second insulating layers 11 and 12 are formed by bonding resin films each having an adhesive layer (which is not illustrated) on an inner surface (i.e., a bonding surface). For the first and second insulating layers 11 and 12 themselves, a general resin film having suitable flexibility is used, and, for example, a versatile resin film, such as a polyester resin, a polyphenylene sulfide resin, and a polyimide resin may be used. The thickness of the resin film is from 9 μm to 400 μm. Examples of the polyester resin include resin materials such as a polyethylene terephthalate resin, a polyethylene naphthalate resin, and a polybutylene naphthalate resin.

For the adhesive layers of the first and second insulating layers 11 and 12, layers made of resin materials are used, and examples of the adhesive layers include an adhesive made by adding a flame retardant to a polyester-based resin or a polyolefin-based resin. The adhesive layer is formed with a thickness from 10 μm to 100 μm. The first and second insulating layers 11 and 12 are bonded and combined by interposing the pair of signal wires S1 and S2, the ground wire G1, and the power wires P1 and P2 between the adhesive layers of two resin films in a state in which the adhesive layers face each other, and joining the adhesive layers by applying heat with heating rollers.

The first shield layer 21 and the second shield layer 22 each have a thickness of about 10 μm to 200 μm. The first shield layer 21 and the second shield layer 22 are each formed using a film of two layers, which are one metal layer and one conductive adhesive layer (which is not illustrated). As the metal layers of the first and second shield layers 21 and 22, for example, a metal foil or a metal deposition film formed on an insulating film may be used. As the metallic materials of the first and second shielding layers 21 and 22, copper or aluminum, which are relatively low cost and has excellent electrical conductivity, is preferably used. When the thickness of the first and second shielding layers 21 and 22 is too small, the shielding effect is reduced because the electrical resistance of the shield layer is increased. Conversely, when the thickness of the first and second shield layers 21 and 22 is large, the shielding effect can be obtained, but electrical connection with the ground wire G1 and the flexibility of the shielded flat cable 1 may be impaired.

The first and second shield layers 21 and 22 are bonded, with the conductive adhesive layer being inside, on the first and second insulating layers 11 and 12, and on the ground wires G1 at the openings 13 and 14. The first and second shield layers 21 and 22 are bonded at the ends of the shielded flat cable with conductive adhesive layers, so that the pair of signal wires S1 and S2 are surrounded and shielded by the first shield layer 21, the ground wire G1, the second shield layer 22 and the end A. The shielded flat cable 1 is connected to a substrate constituting equipment, and at the same time, the shielded flat cable 1 is electrically connected to a ground layer of the substrate to be grounded. As described above, in the present embodiment, the ground wire G1 serves as a shield to block noise from sides of the signal wires S1 and S2 in the array direction, thereby improving the noise reduction effect.

Next, an example of a method of manufacturing the shielded flat cable according to the present embodiment will be described. FIGS. 2A and 2B are drawings illustrating an example of a process of manufacturing the shielded flat cable according to the first embodiment of the disclosure. As illustrated in FIG. 2A, the respective flat conductors, which are the signal wires S1 and S2, the ground wire G1, and the power wires P1 and P2, are arrayed parallel with predetermined intervals, and from the upper and lower sides, the conductors are interposed between the insulating films provided with inner bonding layers and are joined by heating with heating rollers, thereby producing a long flat cable in which the first and second insulating layers 11 and 12 are seamlessly formed at both surfaces of each conductor.

Next, as illustrated in FIG. 2B, the first and second insulating layers 11 and 12 of both surfaces of the ground wire G1 are removed with a predetermined width W2 through the entire length in the longitudinal direction so as to form the openings 13 and 14. As a method of removal, a laser processing method, a solvent dissolution method, or a mechanical removal method may be used, for example. Here, the width W2 of the openings 13 and 14 is preferably smaller than or equal to half of the width W1 of the ground wire G1. This is for maintaining the bonding strength of the ground wire G1 and the first and second insulating layers 11 and 12 even when the openings 13 and 14 are provided, as the pair of signal wires S1 and S2, the ground wire G1, and the power wires P1 and P2 are held by the first and second insulating layers 11 and 12 that are obtained by bonding the two resin films. The width W2 of the openings 13 and 14 is preferably greater than or equal to one-third of the width W1 of the ground wire G1 in order to maintain electrical connection between the ground wire G1 and the first and second shield layers 21 and 22. The width W2 of the openings 13 and 14 is, for example, 0.3 mm to 2.5 mm. When a top surface and a bottom surface of the ground wire G1 are defined as bottom surfaces of the openings 13 and 14 in a cross section orthogonal to the longitudinal direction of the ground wire G1, the width W2 of the openings 13 and 14 is the width of the bottom surfaces of the openings 13 and 14. The width of the openings 13 and 14 may be of different sizes.

Next, as illustrated in FIG. 1, the first and second shield layers 21 and 22, which are wider than the width of array positions of the signal wires S1 and S2 and the ground wire G1, are formed to cover the signal wires S1 and S2 and the ground wire G1. Here, the first and second shield layers 21 and 22 are not provided at an area in which the power wires P1 and P2 are arrayed. The first and second shield layers 21 and 22 can be formed, for example, by bonding two-layer metal foil tapes having a conductive adhesive layer on a metal layer, with the conductive adhesive layer being inside, by heating with heating rollers from both sides of the flat cable illustrated in FIG. 2B. A heat bonding process causes the first and second shield layers 21 and 22 to be electrically coupled to the ground wire G1 and to be directly electrically coupled to the end A protruding from the side of the flat cable in the width direction.

The shielded flat cable 1 obtained in the above-described process is provided with a protective resin layer that covers an entirety of the shielded flat cable 1 except for the terminal, as necessary. The protective resin layer can be formed by bonding two resin films, between which the shielded flat cable 1 is interposed, by heating.

Second Embodiment

Figure 3:
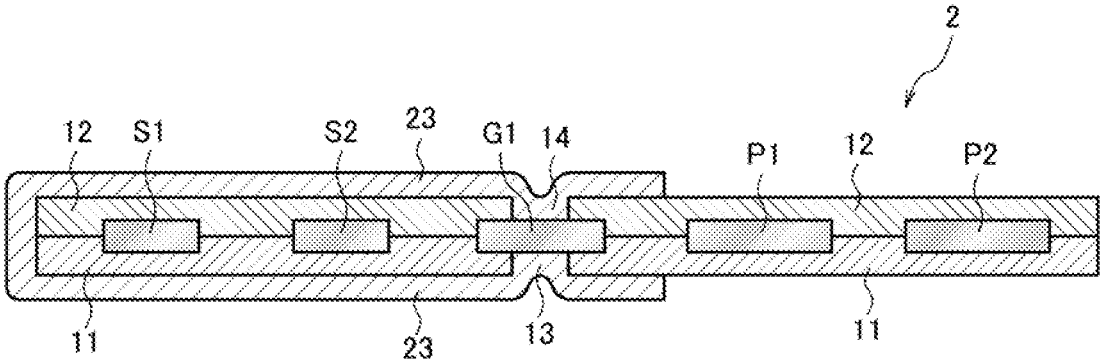
FIG. 3 is a cross-sectional view orthogonal to the longitudinal direction, illustrating a schematic view of a shielded flat cable according to a second embodiment of the present disclosure.

FIG. 3 is a cross-sectional view orthogonal to the longitudinal direction, illustrating a schematic view of a shielded flat cable according to a second embodiment of the present disclosure. In the first embodiment, for example, the first and second shield layers 21 and 22 are formed by bonding two metal foil tapes each having a two-layer structure, in which a conductive adhesive layer is provided on a metal layer, on the flat cable from the front and back sides. However, in a shielded flat cable 2 according to the present embodiment, signal wires S1 and S2 and the ground wire G1 are covered by one shield layer 23.

Thus, in the present embodiment, a single sheet of metal foil tape is bent in a C shape so that the conductive adhesive layer becomes an inner surface, and a flat cable is inserted from an opening side of the C-shaped metal foil tape until a side of the flat cable reaches an innermost surface of the C-shaped metal foil tape. In this state, the metal foil tape is bonded on the first and second insulating layers 11 and 12 and the ground wire G1 by heating with heating rollers from both sides of the conductor, thereby forming the shield layer 23. In the present embodiment, similarly with the first embodiment, with respect to the first and second shield layers 21 and 22 being not required to be directly electrically coupled at the end A protruding from the side of the flat cable in the width direction, the shield layer provided on both sides of the shielded flat cable 2 can be electrically coupled with certainty. The other components are similar to the components of the first embodiment, so the description will be omitted.

Third Embodiment

Figure 4:
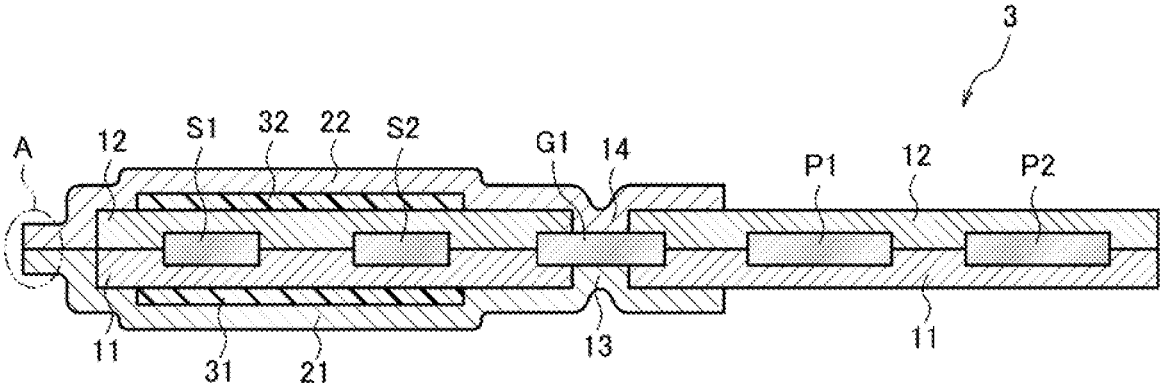
FIG. 4 is a cross-sectional view orthogonal to the longitudinal direction, illustrating a schematic view of a shielded flat cable according to a third embodiment of the present disclosure.

FIG. 4 is a cross-sectional view orthogonal to the longitudinal direction, illustrating a schematic view of a shielded flat cable according to a third embodiment of the present disclosure. In a shielded flat cable 3, for example, the thickness, the width, and the interval of the signal wires S1 and S2 and the permittivity of the first and second insulating layers 11 and 12 are adjusted so that the characteristic impedance becomes a predetermined value (e.g., 90Ω or 100Ω). In the present embodiment, resin interlayers 31 and 32 for the impedance adjustment are respectively interposed between the first insulating layer 11 and the first shield layer 21 and between the second insulating layer 12 and the second shield layer 22 at positions where the signal wires S1 and S2 are located to facilitate the adjustment of the characteristic impedance. The resin interlayers 31 and 32 may be interposed between the first insulating layer 11 and the first shield layer 21 and between the second insulating layer 12 and the second shield layer 22 by providing an adhesive layer on one surface of each of the resin interlayers 31 and 32, and then bonding the respective adhesive layers on the first and second insulating layers 11 and 12 in a state in which the respective adhesive layers face toward the first and second insulating layers 11 and 12. In the present embodiment, the first and second shield layers 21 and 22 are provided to cover surfaces of the resin interlayers 31 and 32.

Fourth Embodiment

Figure 5:
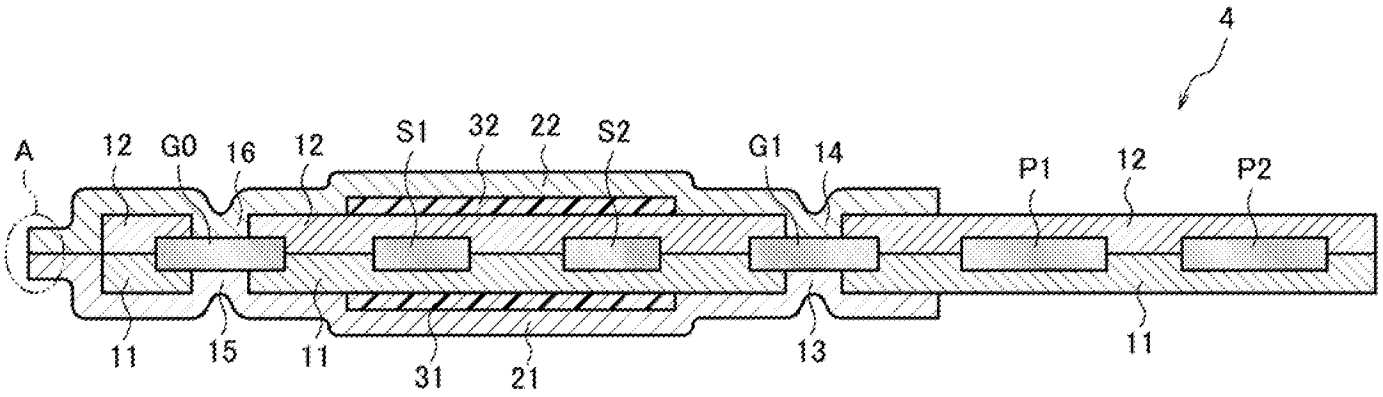
FIG. 5 is a cross-sectional view orthogonal to the longitudinal direction, illustrating a schematic view of a shielded flat cable according to a fourth embodiment of the present disclosure.

FIG. 5 is a cross-sectional view orthogonal to the longitudinal direction, illustrating a schematic view of a shielded flat cable according to a fourth embodiment of the present disclosure. A shielded flat cable 4 of the present embodiment includes multiple conductors arrayed parallel to each other including one ground wire G0, the pair of signal wires S1 and S2 for differential transmission, one ground wire G1, and two power wires P1 and P2. The shielded flat cable 4 includes the first insulating layer 11 and the second insulating layer 12 covering the multiple conductors, and the first shield layer 21 and the second shield layer 22 covering portions of outer surfaces of the first and second insulating layers 11 and 12, respectively. As in the third embodiment, the resin interlayers 31 and 32 for the impedance adjustment are respectively interposed between the first insulating layer 11 and the first shield layer 21 and between the second insulating layer 12 and the second shield layer 22 at positions where the signal wires S1 and S2 are located to facilitate the adjustment of the characteristic impedance.

In the present embodiment, with respect to the third embodiment, a ground wire G0 is disposed on a side opposite to the ground wire G1 in the array direction of the pair of signal wires S1 and S2 (an end A side), the openings 15 and 16 are formed in the longitudinal direction of the first and second insulating layers 11 and 12 covering both sides of the ground wire G0, and the first and second shield layers 21 and 22 are electrically coupled to the ground wire G0 at the respective openings 15 and 16. Thus, the pair of signal wires S1 and S2 of the shielded flat cable 4 is surrounded and shielded by the ground wire G0, the first shield layer 21, the ground wire G1, and the second shield layer 22. Because the ground wires G0 and G1 are symmetrically arranged on both sides of the pair of signal wires S1 and S2 in the array direction, excellent transmission characteristics can be obtained. In the present embodiment, the first and second shield layers 21 and 22 may not be directly contacted by the end A protruding from the side surface of the flat cable in the width direction.

Fifth Embodiment

Figure 6:
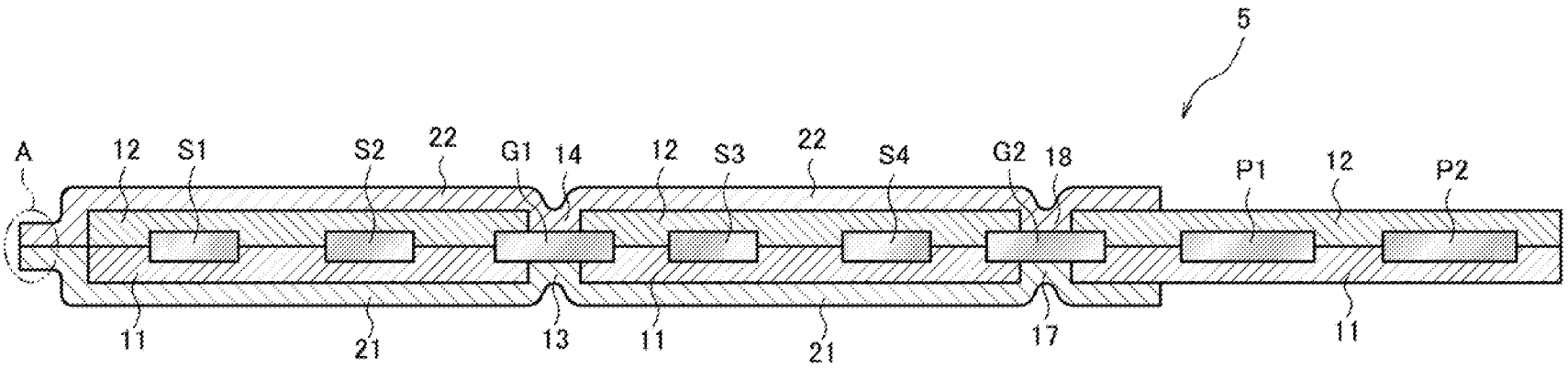
FIG. 6 is a cross-sectional view orthogonal to the longitudinal direction, illustrating a schematic view of a shielded flat cable according to a fifth embodiment of the present disclosure.

FIG. 6 is a cross-sectional view orthogonal to the longitudinal direction, illustrating a schematic view of a shielded flat cable according to a fifth embodiment of the disclosure. A shielded flat cable 5 of the present embodiment includes multiple conductors arrayed parallel to each other including the pair of signal wires S1 and S2 for the differential transmission, one ground wire G1, a pair of signal wires S3 and S4 for the differential transmission, one ground wire G2, and two power wires P1 and P2. When the signal wire is S and the ground wire is G, in the present embodiment, the signal wires S and the ground wires G are arrayed from the end A side in an array of SSGSSG. The shielded flat cable 5 includes the first insulating layer 11 and the second insulating layer 12 that are respectively disposed on both sides of the multiple conductors, and the first shield layer 21 and the second shielding layer 22 that respectively cover portions of outer surfaces of the first and second insulating layers 11 and 12.

In the present embodiment, the array of the signal wires S1 and S2 and the ground wire G1 is the same as the array in the first embodiment, but the signal wires S3 and S4 and the ground wire G2 are arrayed between the ground wire G1 and the power wire P1. With respect to the signal wires S3 and S4, the ground wire G1 and the ground wire G2 are arranged on both sides of the signal wires in the array direction.

Exposed surfaces are formed on both surfaces of the ground wire G1 by the openings 13 and 14 provided in the first and second insulating layers 11 and 12, and similarly, exposed surfaces are formed on both surfaces of the ground wire G2 by openings 17 and 18 provided in the first and second insulating layers 11 and 12 through the entire length of the ground wire G2 in the longitudinal direction. The ground wire G1 and the first and second shield layers 21 and 22 are electrically coupled at the openings 13 and 14, and the ground wire G2 and the first and second shield layers 21 and 22 are electrically coupled at the openings 17 and 18.

Thus, the pair of signal wires S1 and S2 located at an end of the shielded flat cable 5 is surrounded and shielded by the first shield layer 21, the ground wire G1, the second shield layer 22, and the end A, as in the first embodiment. The pair of signal wires S3 and S4 located near the center is surrounded and shielded by the ground wire G1, the first shield layer 21, the ground wire G2, and the second shield layer 22. The power wires P1 and P2 are not shielded because the first and second shield layers 21 and 22 are not provided at positions in which the power wires P1 and P2 are arrayed.

Thus, in the present embodiment, the signal wires S3 and S4 are surrounded by two ground wires G1 and G2 at need on both sides in the array direction of the signal wires, and the first and second shield layers 21 and 22 are electrically coupled to the two ground wires G1 and G2 at the openings 13 and 14 and the openings 17 and 18, winch are respectively provided on both sides of the two ground wires G1 and G2. Therefore, because the two ground wires G1 and G2 function as a shield to block noise from sides of the signal wires S3 and S4 in the array direction, the noise reduction effect can be improved.

Sixth Embodiment

Figure 7:
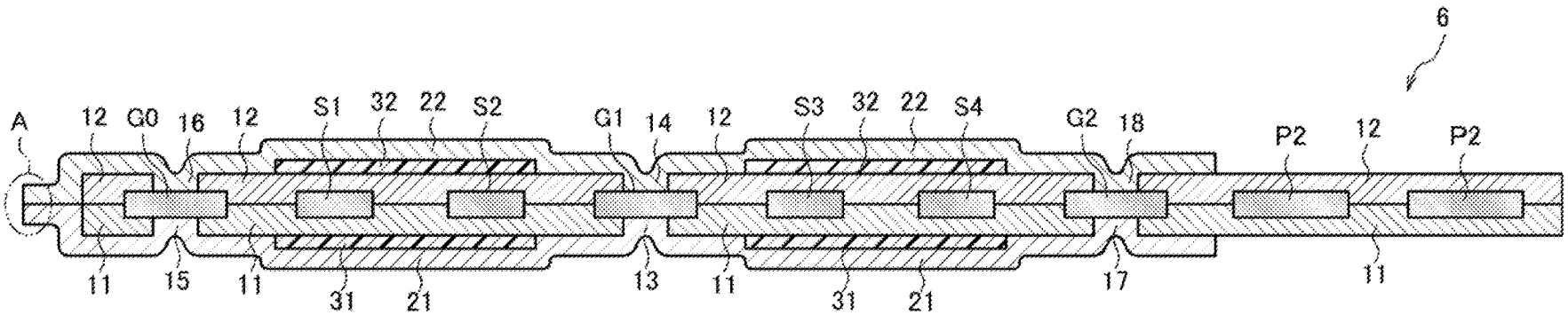
FIG. 7 is a cross-sectional view orthogonal to the longitudinal direction, illustrating a schematic view of a shielded flat cable according to a sixth embodiment of the present disclosure.

FIG. 7 is a cross-sectional view orthogonal to the longitudinal direction, illustrating a schematic view of a shielded flat cable according to a sixth embodiment of the present disclosure. A shielded flat cable 6 in the present embodiment includes multiple conductors arrayed parallel to each other, including one ground wire G0, the pair of signal wires S1 and S2, one ground wire G1, the pair of signal wires S3 and S4 for differential transmission, one ground wire G2, and two power wires P1 and P2. In the present embodiment, the signal wires S and the ground wires G are arrayed from the end A side in an array of GSSGSSG.

The shielded flat cable 6 includes the first insulating layer 11 and the second insulating layer 12 respectively disposed on both sides of the multiple conductors, and the first shield layer 21 and the second shield layer 22 respectively covering portions of outer surfaces of the first and second insulating layers 11 and 12. Additionally, as in the third and fourth embodiments, the resin interlayers 31 and 32 for the impedance adjustment are respectively interposed between the first insulating layer 11 and the first shield layer 21 and between the second insulating layer 12 and the second shield layer 22 at positions where the signal wires S1 and S2 are located and the signal wires S3 and S4 are located to facilitate the adjustment of the characteristic impedance.

In the present embodiment, in addition to the resin interlayers 31 and 32 interposed for the impedance adjustment, the ground wire G0 is disposed on a side opposite to the ground wire G1 in the array direction of the pair of signal wires S1 and S2 (i.e., the end A side), and the openings 15 and 16 are formed in the longitudinal direction of the first and second insulating layers 11 and 12 covering both sides of the ground wire G0, and the first and second shield layers 21 and 22 and the ground wire G0 are electrically coupled at the openings 15 and 16 in the fifth embodiment.

Thus, the pair of signal wires S1 and S2 of the shielded flat cable 6 is surrounded and shielded by the ground wire G0, the first shield layer 21, the ground wire G1, and the second shield layer 22. Similarly, the pair of signal wires S3 and S4 is surrounded and shielded by the ground wire G1, the first shield layer 21, the ground wire G2, and the second shield layer 22. As described, the ground wires G0 and G1 and the ground wires G1 and G2 are respectively arranged symmetrically on both sides of the pair of signal wires S1 and S2 and the pair of signal wires S3 and S4 in the array direction, so that excellent transmission characteristics can be obtained. In the present embodiment, the first and second shield layers 21 and 22 may not be directly contacted at the end A protruding from the side surface of the flat cable in the width direction.

In the fifth and sixth embodiments, a configuration in which multiple (e.g. two) signals are transmitted using the differential transmission has been described. However, when differential transmission is not performed, a single signal wire may be used instead of two signal wires. When three or more signals are transmitted, with respect to signal wires for each unit of the signals to be transmitted (e.g., two signal wires when the differential transmission is performed), the ground wire may be simply arranged on each side of the signal wires of each unit of the signals to be transmitted in the parallel direction and the ground wire may be simply electrically coupled to the shield layers through openings provided at the ground wire.

As describe above, although the embodiments of the present disclosure have been described, the number of signal wires and the number of ground wires in the shielded flat cable of the present disclosure are not limited to the numbers used in the embodiments described above. The signal wires S and the ground wires G may be arrayed as SSGSSG, or GSSGSSG. Additionally, the disposition of the power wire can be determined as desired. If necessary, the power wire may be surrounded and shielded by the ground wire and the shield layer, as well as the signal wire.

Reference Example

Figure 8:
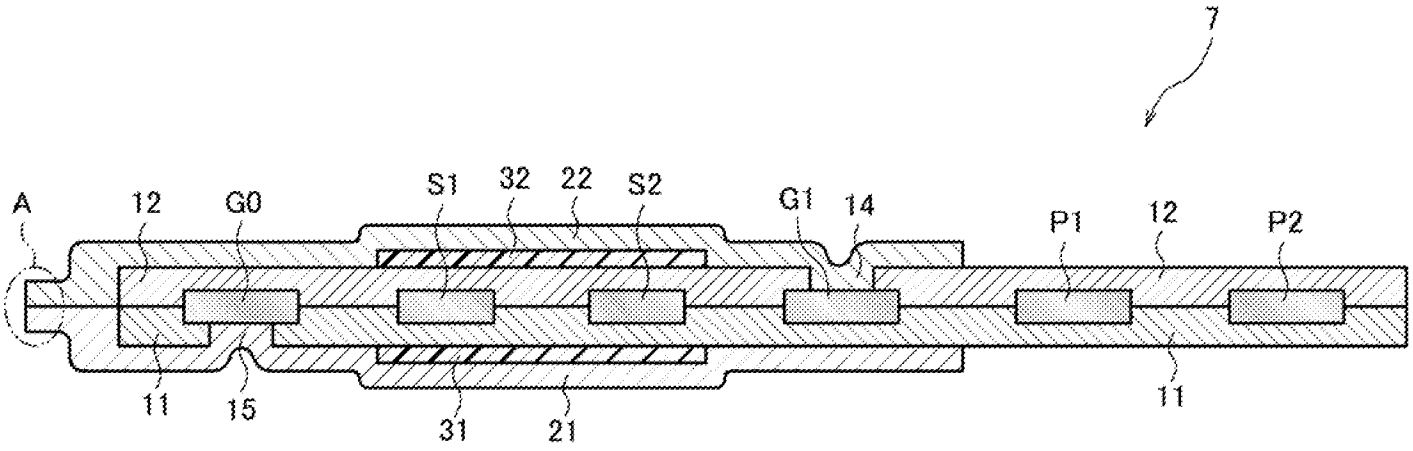
FIG. 8 is a cross-sectional view orthogonal to the longitudinal direction, illustrating a schematic view of a shielded flat cable according to a reference example electrically equivalent to the present disclosure.

FIG. 8 is a cross-sectional view orthogonal to the longitudinal direction, illustrating a schematic view of a shielded flat cable according to a reference example electrically equivalent to the present disclosure. A shielded flat cable 7 of the reference example includes multiple conductors arrayed parallel to each other, including one ground wire G0, the pair of signal wires S1 and S2 for the differential transmission, one ground wire G1, and two power wires P1 and P2. In the reference example, the signal wires S and the ground wires G are arrayed as GSSG, and the ground wires G0 and G1 are respectively arranged on both sides of the pair of signal wires S1 and S2 in the array direction. The array is the same as the array in the fourth embodiment illustrated in FIG. 5.

The shielded flat cable 7 includes the first insulating layer 11 and the second insulating layer 12 disposed on both sides of the multiple conductors, and the first shield layer 21 and a second shield layer 22 respectively covering portions of outer surfaces of the first and second insulating layers 11 and 12. As in the third embodiment, the resin interlayers 31 and 32 for the impedance adjustment are respectively interposed between the first insulating layer 11 and the first shield layer 21 and between the second insulating layer 12 and the second shield layer 22 at positions where the signal wires S1 and S2 are located, to facilitate the adjustment of the characteristic impedance. The components of the reference example, that is, the ground wires G0 and G1, the pair of signal wires S1 and S2 for the differential transmission, the two power wires P1 and P2, the first and second insulating layers 11 and 12, the first and second shield layers 21 and 22, and the resin interlayers 31 and 32 are the same as the components of the first to sixth embodiments, so the description will be omitted.

In the reference example, an opening 15 is provided on a first insulating layer 11 side of the ground wire G0 through the entire length of the ground wire G0 in the longitudinal direction, and the ground wire G0 and the first shield layer 21 are electrically coupled at an exposed surface formed by the opening 15. Additionally, an opening 14 is provided on a second insulating layer 12 side of the ground wire G1 through the entire length in the longitudinal direction, and the ground wire G1 and the second shield layer 22 are electrically coupled at an exposed surface formed by the opening 14. Further, the first and second shield layers 21 and 22 are electrically coupled at the end A protruding from the side of the shielded flat cable 1 in the width direction. Thus, the ground wire G0 and the ground wire G1 are electrically coupled.

The first shield layer 21 extends over the signal wires S1 and S2 to near the power wire P1 and the ground wire G1. Thus, the signal wires S1 and S2 are generally surrounded and shielded by the ground wire G0, the first shield layer 21, the ground wire G1, and the second shield layer 22. The ground wire G1 functions as a shield to block noise from a side of the signal wires S1 and S2 in the array direction, and the condition is almost equivalent to the shielded flat cable 4 illustrated in FIG. 5.

In the reference example, because the openings provided at the ground wires G0 and G1 are not provided on both sides as in the first embodiment to the sixth embodiment, and are provided only on one side, even in a severe use environment, the insulating layer is not separated at positions of the ground wires G0 and G1, and the bonding strength of the ground wires G0 and G1 with the first and second insulating layers 11 and 12 can be maintained. In the reference example, the first and second shield layers 21 and 22 do not necessarily need to directly come in contact with the end A protruding from a side surface of the flat cable in the width direction. In addition, the number of signal wires S and the number of ground wires G are not limited as long as the array of the signal wires S and the ground wires G is "GSSGSSG . . . ". Further, the disposition of the power wires can be determined as desired.

DESCRIPTION OF THE REFERENCE NUMERALS

1 to 4 shielded flat cable
11 first insulating layer
12 second insulating layer
13 to 18 opening
21 first shield layer
22 second shield layer
23 shield layer
G0, G1, G2 ground wire
P1, P2 power wire
S1 to S4 signal wire

The invention claimed is:

1. A shielded flat cable comprising:

one or more ground wires arrayed, the ground wires being parallel to each other;

one or more signal wires arrayed parallel to the one or more ground wires;

an insulating layer covering the one or more ground wires and the one or more signal wires; and a shield layer provided on an outer surface of the insulating layer, wherein the insulating layer includes a plurality of openings of which bottoms are respectively an upper surface and a lower surface of each of the one or more ground wires in a cross-section orthogonal to a longitudinal direction of the one or more ground wires, and wherein the one or more ground wires and the shield layer are electrically coupled at the plurality of openings, and each of the one or more signal wires is surrounded by the one or more ground wires and the shield layer, wherein a resin interlayer is interposed between the insulating layer and the shield layer, and wherein the resin interlayer extends in an array direction in which the one or more signal wires are arrayed side by side, such that one end of the resin interlayer in the array direction is situated, in the array direction, at a space between one signal wire among the one or more signal wires and one ground wire among the one or more ground wires.

2. The shielded flat cable as claimed in claim 1, wherein the one or more signal wires arrayed on one end of an array of the one or more ground wires and the one or more signal wires are surrounded by a closest ground wire and the shield layer electrically coupled at the plurality of openings of which bottoms are respectively an upper surface and a lower surface of the closest ground wire, in the cross-section orthogonal to the longitudinal direction of the one or more ground wires, the closest ground wire being closest to the one or more signal wires arrayed on the one end.

3. The shielded flat cable as claimed in claim 1, wherein, in the cross-section orthogonal to the longitudinal direction of the one or more ground wires, the one or more signal wires are surrounded by two ground wires among the ground wires and the shield layer, the one or more signal wires being disposed between the two ground wires, the ground wires and the shield layer being electrically coupled at the plurality of openings, and bottoms of the plurality of openings being respectively upper surfaces and lower surfaces of the two ground wires between which the one or more signal wires are disposed.

4. The shielded flat cable as claimed in claim 1, wherein the one or more signal wires include one signal wire for signal transmission or a pair of signal wires arranged adjacent and parallel to each other for differential transmission.

5. The shielded flat cable as claimed in claim 1, wherein a width of the plurality of openings is smaller than or equal to half of a width of the one or more ground wires in an array direction.

6. The shielded flat cable as claimed in claim 1, further comprising a power wire of which an outer surface is covered by only the insulating layer.

7. The shielded flat cable as claimed in claim 1, wherein a width of the one or more ground wires is greater than a width of the one or more signal wires.

8. The shielded flat cable as claimed in claim 7, further comprising one or more power wires, wherein a cross-sectional area of the one or more power wires is greater than a cross-sectional area of the one or more ground wires.

9. The shielded flat cable as claimed in claim 8, wherein one of the one or more ground wires and one of the one or more power wires are arranged side by side, and ends of the shield layer are disposed over and under a position between the one of the one or more ground wires and the one of the one or more power wires.

10. The shielded flat cable as claimed in claim 1, wherein the one or more signal wires include a first signal wire and a second signal wire arranged adjacent and parallel to each other for differential transmission, the first signal wire and the second signal wire each having a first side portion and a second side portion wherein the first side portion of the first signal wire faces a side edge of the shield layer, the first side portion of the first signal wire facing away from the second signal wire, wherein the second side portion of the second signal wire faces a side portion of the one ground wire, the second side portion of the second signal wire facing away from the first signal wire, and wherein the resin interlayer extends in the array direction, such that the one end of the resin interlayer in the array direction is situated, in the array direction, at a space between the second signal wire and the one ground wire, and another end of the resin interlayer in the array direction is situated, in the array direction, at a space between the first signal wire and an end of the insulating layer situated toward the side edge of the shield layer.

11. The shielded flat cable as claimed in claim 1, wherein the one or more signal wires include a first signal wire and a second signal wire arranged adjacent and parallel to each other for differential transmission, the second signal wire being the one signal wire, the first signal wire and the second signal wire each having a first side portion and a second side portion, wherein the first side portion of the first signal wire faces a side portion of another ground wire among the one or more ground wires, the first side portion of the first signal wire facing away from the second signal wire, wherein the second side portion of the second signal wire faces a side portion of the one ground wire, the second side portion of the second signal wire facing away from the first signal wire, and wherein the resin interlayer extends in the array direction, such that the one end of the resin interlayer in the array direction is situated, in the array direction, at a space between the second signal wire and the one ground wire, and another end of the resin interlayer in the array direction is situated, in the array direction, at a space between the first signal wire and the another ground wire.

12. The shielded flat cable as claimed in claim 6, wherein the one ground wire is disposed between the power wire and the one signal wire.

13. The shielded flat cable as claimed in claim 12, wherein the shield layer extends in the array direction, such that an end of the shield layer in the array direction is situated, in the array direction, at a space between the one ground wire and the power wire.

* * * * *